United States Patent [19]

Gilmore

[11] 4,167,001

[45] Sep. 4, 1979

[54] STEPPING SWITCH CONTROLLED TRAFFIC SIGNAL DEVICES

[76] Inventor: Ralph W. Gilmore, P.O. Box 426, Brundidge, Ala. 36010

[21] Appl. No.: 816,170

[22] Filed: Jul. 15, 1977

[51] Int. Cl.[2] ..... G08G 1/00

[52] U.S. Cl. ..... 340/43; 340/373

[58] Field of Search ..... 340/43, 44, 373, 375, 340/334, 338, 753, 754; 116/63 R; 40/557, 612; 200/38 R, 38 B, 38 C, 38 D

[56] References Cited

U.S. PATENT DOCUMENTS

| | | | |
|---|---|---|---|
| 2,101,697 | 12/1937 | Watson | 340/43 |
| 2,480,290 | 8/1949 | Fein | 340/43 |
| 2,588,739 | 3/1952 | Main | 340/43 |
| 2,842,627 | 7/1958 | Wagner | 340/43 |
| 3,200,218 | 8/1965 | Wagner | 340/43 |
| 3,408,623 | 10/1968 | Wagner | 340/43 |
| 3,970,988 | 7/1976 | Gilmore | 340/43 |

*Primary Examiner*—John W. Caldwell, Sr.
*Assistant Examiner*—James J. Groody
*Attorney, Agent, or Firm*—Watson, Cole, Grindle & Watson

[57] ABSTRACT

A plurality of horizontally extending rows of alternately green and red signal lights are provided in a signal display grid in each of two respective traffic signal devices. Each traffic signal device includes a STOP-GO indicator and a street indicator positioned respectively at the top and the bottom of the grid. To the left and right of the grid in each traffic device are respectively positioned red and green vertical strip indicators. Stepping switch control circuitry actuates the aforementioned lighting elements such that the red and green lighting elements in the horizontally extending rows are alternately successively actuated to provide a traffic signal display consisting of a block of lighting elements moving in a downward direction within the grid. The STOP indicator and the red left vertical strip indicator are continuously lit during a "red-light" condition; and the GO indicator and the right vertical strip are continuously lit during a "green-light" condition. A delay is provided in the sequencing of the block of red lighting elements in order to clear traffic through an intersection.

12 Claims, 10 Drawing Figures

GO
STOP
1ST AVE
21ST STREET
24V AC
10
12
14
16
18
20
21
22
23
24
25
26
27
28
29
30
31
32
33
34
35
36
38
40a
40b
40c
40d
40e
40f
40g
40h
42
44
50
52
R
G

42'
44'
SGOP
16'
21'
14'
22'
23'
24'
25'
26'
27'
28'
29'
30'
31'
32'
33'
34
35'
36'
20'
86
84
78
90a
91a
92a
93a
94a
95a
96a
97a
98a
99a
100a
101a
102a
103a
104a
105a
106a
TO TERMINALS 90b-106b FIG. 6B
70a
72a
74
STEPPING SWITCH RELAY
62
M
60
12V
24V
TERMINALS 107a-151a TO 107b-151b FIG. 6B

TO TERMINALS 90a - 106a FIG. 6A
TO TERMINALS 161c - 177c FIG. 6C
TERMINALS 107b - 151b TO 107a - 151a FIG. 6A
TERMINALS 107b - 159b TO 107c - 159c FIG. 6C
78
90b
91b
92b
93b
94b
95b
96b
97b
98b
99b
100b
101b
102b
103b
104b
105b
106b
161b
162b
163b
164b
165b
166b
167b
168b
169b
170b
171b
172b
173b
174b
175b
176b
177b
178b
70b
70c
70d
72b
72c
14
15
16
17
18
19
20
21
22
23
24
25
26
27
28
29
30

44"
78
~ 110V
42"
161c
162c
163c
164c
165c
166c
167c
14"
21"
22"
23"
24"
25"
26"
27"
28"
29"
30"
31"
32"
33"
34"
35"
36"
168c
169c
170c
171c
172c
173c
174c
175c
176c
177c
16"

TO TERMINALS 161b - 177b
178c
1ST AVE
20 STREET
20"
TERMINALS 107c - 159c
TO TERMINALS 107b - 159b

STEPPING SWITCH CONTROLLED TRAFFIC SIGNAL DEVICES

BACKGROUND OF THE INVENTION

1. Field of the Invention

This invention relates generally to traffic signal devices, and more particularly to electrical control circuitry for actuating such devices, enabling motorists and pedestrians to more readily observe the time remaining for a change in a traffic signal and to more adequately anticipate such a traffic signal change.

2. Description of the Prior Art

Standard electronically operated traffic signals in widespread use today alternatively display red and green lights for defining the intervals during which traffic may proceed or may not proceed. The drawbacks with the use of such signal devices include their failure to indicate the interval of time that a given light has before changing from red to green and from green to amber to red or from green directly to red. It is therefore impossible for both motorists and pedestrians to determine whether it would be safe, for example, to proceed even with the green light showing.

Traffic signal devices are known which include arrays of lights designed to be sequentially turned off when changing from one traffic signal to the other traffic signal to thereby inform motorists and pedestrians of the time remaining before each traffic signal changes. However, such prior art devices are deficient in that they fail to adequately provide the motorists and pedestrians with display signals that are adequate to appropriately indicate such time conditions.

SUMMARY OF THE INVENTION

In the electrically operated traffic signal device of the present invention a plurality of horizontally extending rows of alternately green and red signal lights are provided in a signal display grid in each of two respective traffic signal devices. Each traffic signal device further includes a STOP-GO indicator positioned at the top of the aforementioned grid and a street indicator positioned at the bottom of the aforementioned grid. To the left and right of the grid in each traffic device are respectively positioned a red and green vertical strip indicator each extending substantially the length of the grid. Stepping switch control circuitry is provided for actuating the aforementioned lighting elements such that the red and green lighting elements in the horizontally extending rows within each of the traffic signal devices are alternately successively actuated to provide a traffic signal display within the grid that consists of a block of lighting elements which moves in a downward direction from the STOP-GO indicator to the street indicator in successive steps. The STOP indicator and red left vertical strip indicator are continuously lit during a "red-light" condition and the GO indicator and the right vertical strip are continuously lit during a "green-light" condition. A continuous yellow background light is provided for the STOP-GO indicator and the street indicator.

An important feature of the traffic signal device of the present invention is that the amber light is totally eliminated, and in lieu thereof, both crossing directions of the traffic display indicate red signals for a brief period of time which is sufficient to enable traffic that has moved under a green signal to move out of the intersection before the traffic in the other direction is permitted to move. This is accomplished by delaying the lighting of the four red rows on each direction of the traffic signal device through a given number of steps of a stepping switch which actuates the traffic signal devices before the red lights in the horizontal rows extending below the aforesaid four red rows of lights are actuated, while simultaneously delaying the actuation of the green lights in the other direction. This enables four rows of red lights at the bottom of the grid in one traffic signal device to be extinguished as four rows of green lights in the grid of the traffic device for the other direction extinguish and four rows of red lights at the top of the grid are energized. This feature also maintains a consistency for pedestrians and traffic as an imminent change can always be anticipated or expected when either the red or the green horizontal lights in the last four rows of the grid in a traffic display device are energized. It is apparent that for wider or larger intersections, additional time can be provided for the green side traffic to move out of the intersection by providing another step or two for a delay of the extinguishment of the red lights in the four horizontal rows at the top of the grid in a traffic signal device. Alternatively, the stepping switch switching interval can be increased or decreased as desired to accomodate various different traffic conditions.

Another important feature of the traffic device of the present invention resides in the design of a circular type stepping switch having constant contact bars for appropriately operating the vertical red and green indicator strips, positioned along respective sides of each traffic device, and the STOP and GO indicator conditions of each traffic signal device. This enables the elimination of currently used throw switches, which occasionally malfunction and may cause serious accidents, as well as providing a virtually failproof system of electrical operation of a traffic signal device.

A further important feature of the invention is the consistency in the location of the red left and green right vertical indicating strips, which is a considerable aid for the color-blind in perceiving the conditions of a traffic device.

DETAILED DESCRIPTION

Figures 1, 2, 3, 4, 5:
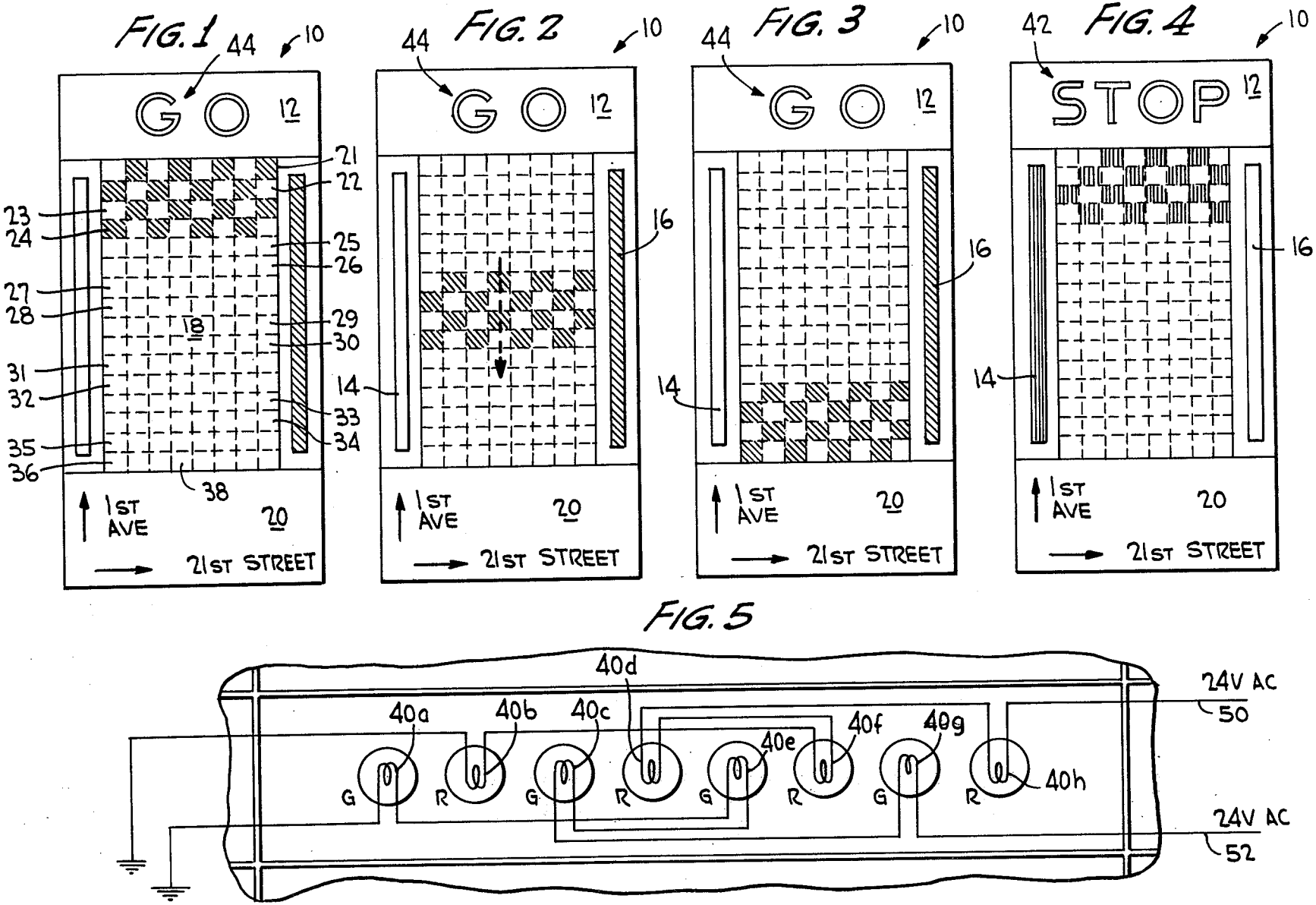
FIGS. 1–4, respectively, indicate successive conditions of a traffic display device in accordance with the principle of operation of a traffic signal device in accordance with the present invention.
FIG. 5 is a representation of the alternately positioned red and green lights in a respective horizontal row of lights in the signal grid display of the traffic display device.

The following is a description of the principle of the sequential operation of the traffic signal device of the present invention with respect to the traffic signal displays illustrated in FIGS. 1–4. Light display 10 includes STOP-GO indicator 12, left red vertical indicator strip 14, right green vertical indicator strip 16, display grid 18 and street indicator portion 20. Display grid 18 consists of sixteen horizontal rows 21–36 of light elements 38, with each horizontal row including a plurality of lighting elements, for example, eight lighting elements **40*a*–40*h* as shown in FIG. 5. The lighting elements 38 may consist of alternating green and red light bulbs 40*a*, 40*b*, 40*c*, . . . 40*h*, with green light bulbs 40*a*, 40*c*, 40*e* and 40*g*; and red light bulbs 40*b*, 40*d*, 40*f* and 40*h* respectively interconnected in series between a 24 volt A.C. terminal and ground as shown in FIG. 5. Bulbs 40*a*–40*h* may also each be white light bulbs with respective red and green transparent covers. Left red vertical indicator strip 14 and right green vertical strip 16 may each respectively comprise a single light strip of red or green, respectively. Alternatively, white strip lights may be used with respective red and green transparent covers. Red and green vertical indicator strips 14, 16 may each comprise respective columns of individual light bulbs, with either respective red or green light bulbs, or white light bulbs with respective red and green transparent covers. Red and green vertical indicator strips 14, 16** provide a failproof means of indicating the condition of a traffic signal device to color-blind people as will be more apparent from the following description.

STOP-GO indicator 12 consists of STOP light indicator 42 (FIG. 4) and GO indicator 44 (FIG. 1), which are separately excitable as will be more fully described hereinafter. Street portion 20 consists of a transparent panel with appropriate opaque lettering. Both STOP-GO indicator 12 and street indicator portion 20 are provided with a yellow background from respective constantly lit lighting elements as will be more fully described hereinafter. Such lighting elements may either be white light bulbs with a yellow transparent panel or yellow light bulbs with a clear transparent cover mounted thereover. For the street portion indicator 20, yellow light bulbs with a clear transparent cover are preferably used for STOP-GO indicator 12 as a colored cover would alter the green-colored light from GO indicator 44 and the red-colored light from STOP indicator 42.

In accordance with the present invention, the green or red light-emitting elements within display grid 18 are energized in groups of horizontal rows, for example, four horizontal rows and either the green or red light bulbs there are lit simultaneously in accordance with whether a GO or STOP condition is to be indicated for the particular traffic direction. For example, for the GO condition, as illustrated in FIG. 1, all the green lighting elements within horizontal rows 21–24 are energized at the beginning of a green light cycle; red light strip 14 remains unenergized; green light strip 16 is energized and GO indicator 40 is lit. In the next sequence of operation (not illustrated), the green lights in horizontal row 21 are extinguished and the green lights in horizontal row 25 are simultaneously energized; then in the next step interval the green lights in horizontal row 22 are extinguished and the green lights in horizontal row 26 are energized. The aforemetioned stepping cycle excitation of the green lights in the horizontal rows of light display grid 18 continues until all the green lights in horizontal rows 27–30 are energized as illustrated in FIG. 2, which represents the midpoint in the cycle of operation of the GO condition of traffic signal device 10 in accordance with the invention.

In the next sequence of several operations (not shown) of traffic light device 10, the green lights in horizontal rows 27 are extinguished, the green lights in horizontal row 31 are energized, and that single step of simultaneous extinguishment of the top horizontal row of green lights and the energization of a next adjacent bottom horizontal row of the group of four horizontal rows of green lights is continued until the display pattern displayed in FIG. 3 is obtained in which all of the green lights in horizontal rows 33–36 are energized. Throughout the aforedescribed sequence of operations, GO indicator 44, vertical red strip indicator 14, vertical green strip indicator 16 and the yellow background of GO indicator 44 and street indicator portion 20 are lit.

In the next sequence of operation immediately subsequent to that which is illustrated in FIG. 3, the red vertical strip indicator 14 and STOP indicator 42 are lit, all of the green lights in horizontal rows 33–36 and green vertical strip 16 are simultaneously extinguished, and the red-emitting light sectors 38 in horizontal rows 21–24 are lit. After a predetermined delay interval the sequencing of the red light in the horizontal rows 21–36 of light display grid 18 progresses in the same manner as described above with respect to the sequential operation of the green lights in each of the horizontal rows 21–36. However, during such sequential operation, STOP indicator 42 and left red vertical strip indicator 14 are energized, and right green vertical strip 16 is unlit. When the sequential operation of the red lights reaches the stage where the red lighting elements in horizontal rows 33–36 are energized, the following sequential operation differs from the green light sequencing described above in that a predetermined delay is provided before red strip vertical indicator 14 and STOP indicator 42 are extinguished and green vertical strip 16 and the green lights in horizontal rows 21–24 are lit.

The yellow background lights for STOP-GO indicator 12 and street portion 20 are lit during the red-light sequencing in the same manner as described above with respect to the green-light sequencing. The signal light operational sequencing for a pair of traffic display devices 10 (North-South and East-West lanes, respectively) set forth in Table I will be more fully referred to hereinafter with respect to the structure and operation of FIGS. 6A–6C.

A typical horizontal row of red lighting elements **40*b*, 40*d*, 40*f* and 40*h* and green lighting elements 40*a*, 40*c*, 40*e* and 406, which are alternately positioned and are serially connected between ground to a respective 24 volt A.C. excitation line 50, 52 is shown in FIG. 5. The 24 volt A.C. excitation is provided to either of lines 50, 52 by a stepping-switch controller to be described more fully hereinafter. The red and green lighting elements may also be respectively connected in parallel to respective 6 volt A.C. lines to provide a safety factor should any one of the lights 40*a*–40*h*** burn out or be inoperative for any reason.

Figure 6A:
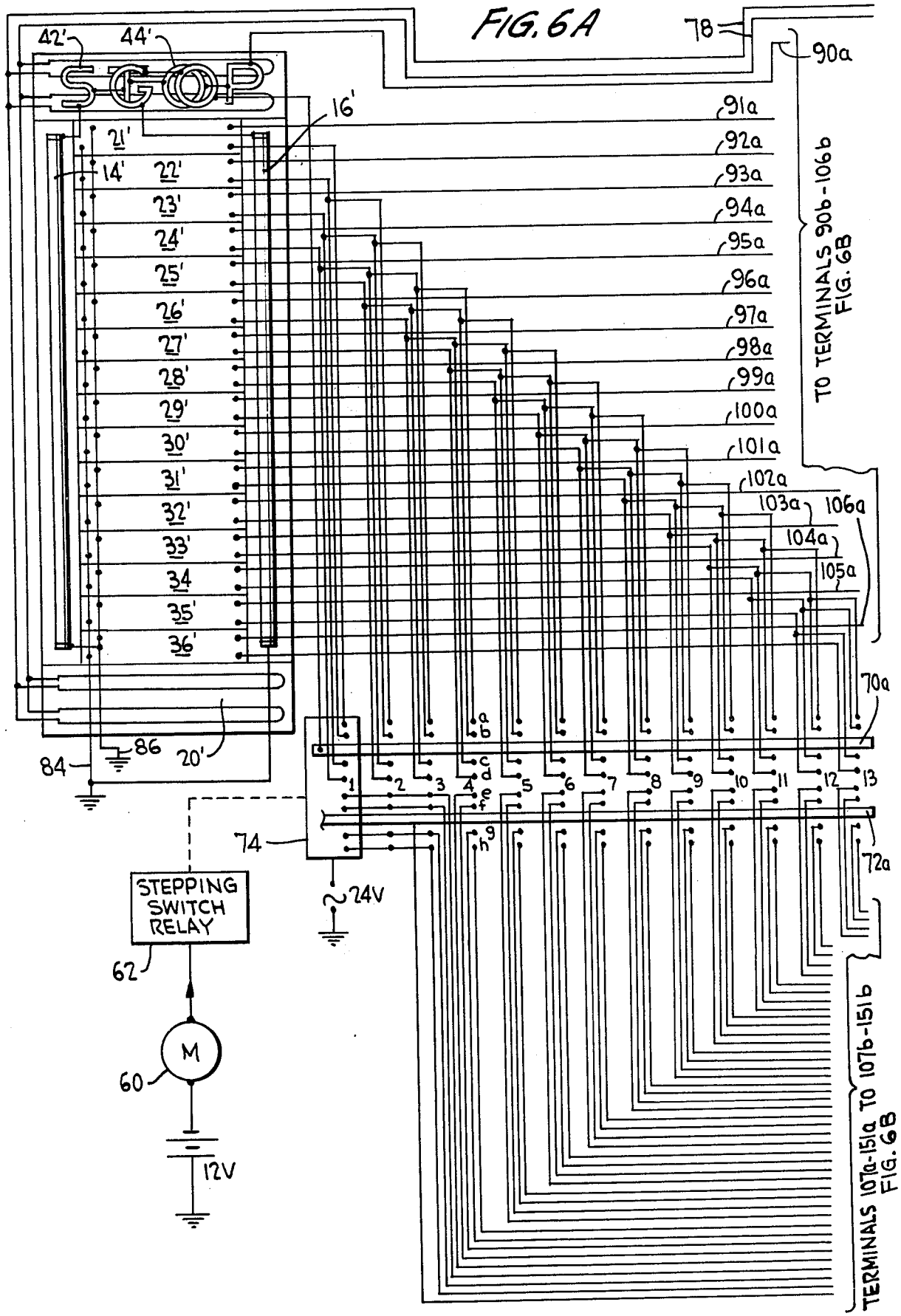
FIGS. 6A–6C illustrate in combined block and schematic form the electronic control circuitry for actuating a traffic display system in accordance with a preferred embodiment of the invention.
Figure 6B:
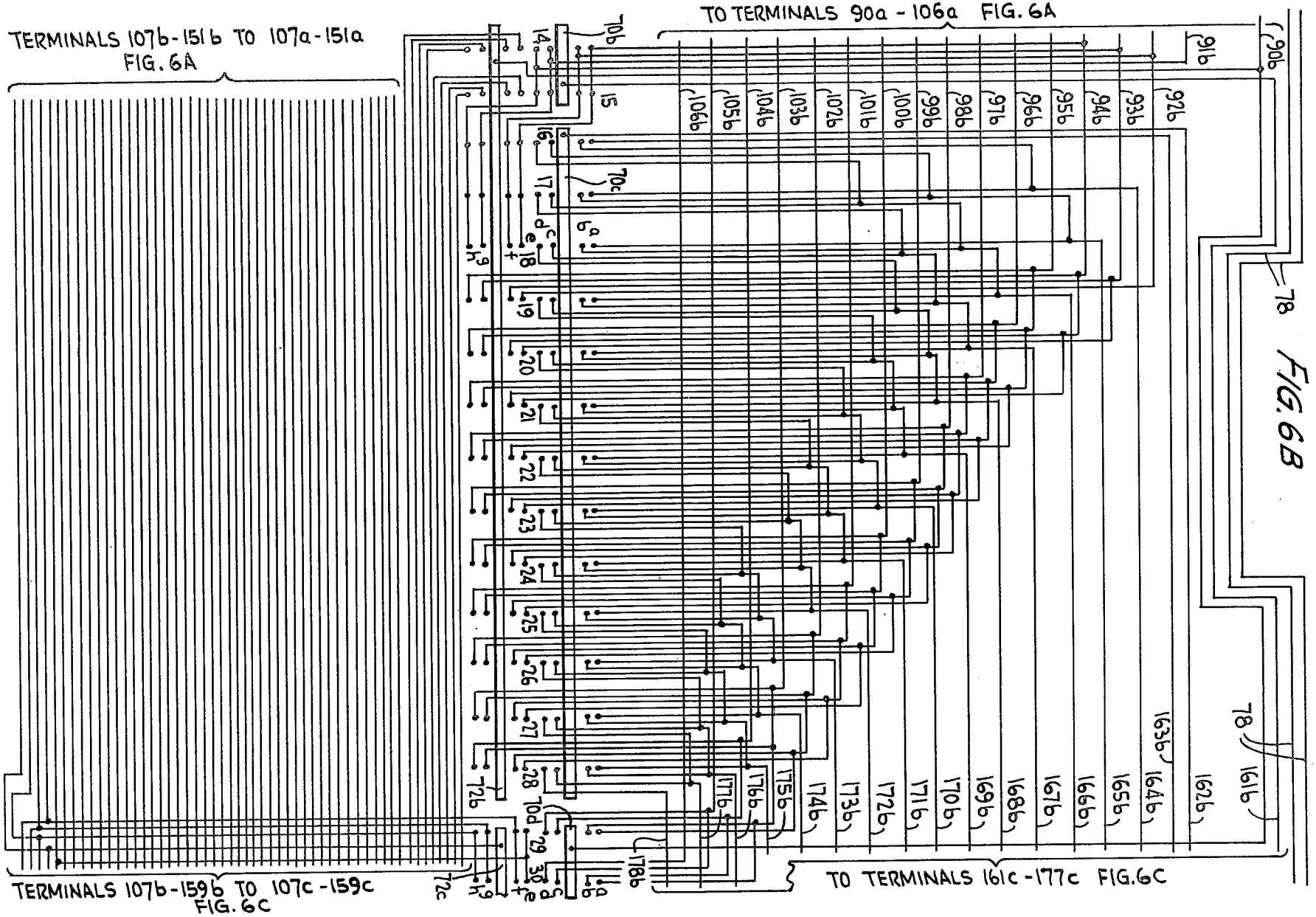
Figures 6B, 6C:
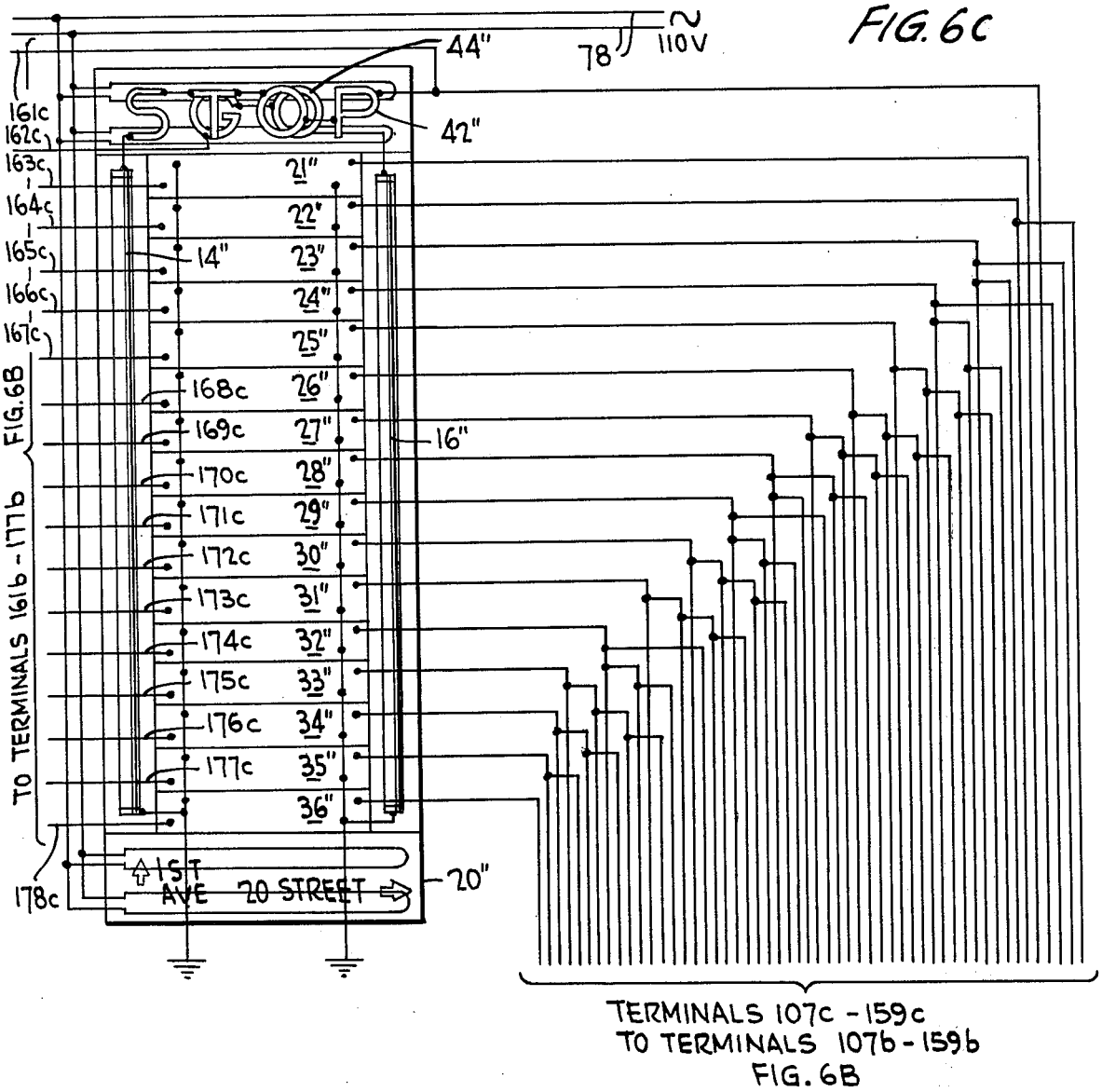

The following is a description of the structure and operation of the stepping switch control circuitry illustrated in FIGS. 6A–6C, with reference to the signal light operational sequence set forth in Table I. Variable speed synchronous motor 60 rotates stepping switch relay 62 to provide a pulse train output to step-rotate the movable contact 74 of a stepping switch (FIG. 7) at spaced intervals, for example, two second intervals. Adjustment of the speed of variable speed synchronous motor 60 varies the pulse interval output from stepping switch relay 62 such that the step rotation interval of stepping switch 64 can be increased or decreased as desired. Alternatively, the speed of synchronous motor 60 may remain constant and the pulse interval output of stepping switch relay 62 increased or decreased by adjusting or changing the gearing (not shown) between the synchronous motor and the stepping switch relay. Stepping switch relay 62 may comprise a series of cams mounted on a shaft driven by the synchronous motor wherein each cam operates a separate switching device, each providing a pulse output of the pulse train. Such stepping switch relays and synchronous motors are well known to those skilled in the art such that further description of their structure and operation is unnecessary for the purposes of the present invention.

Figure 7:
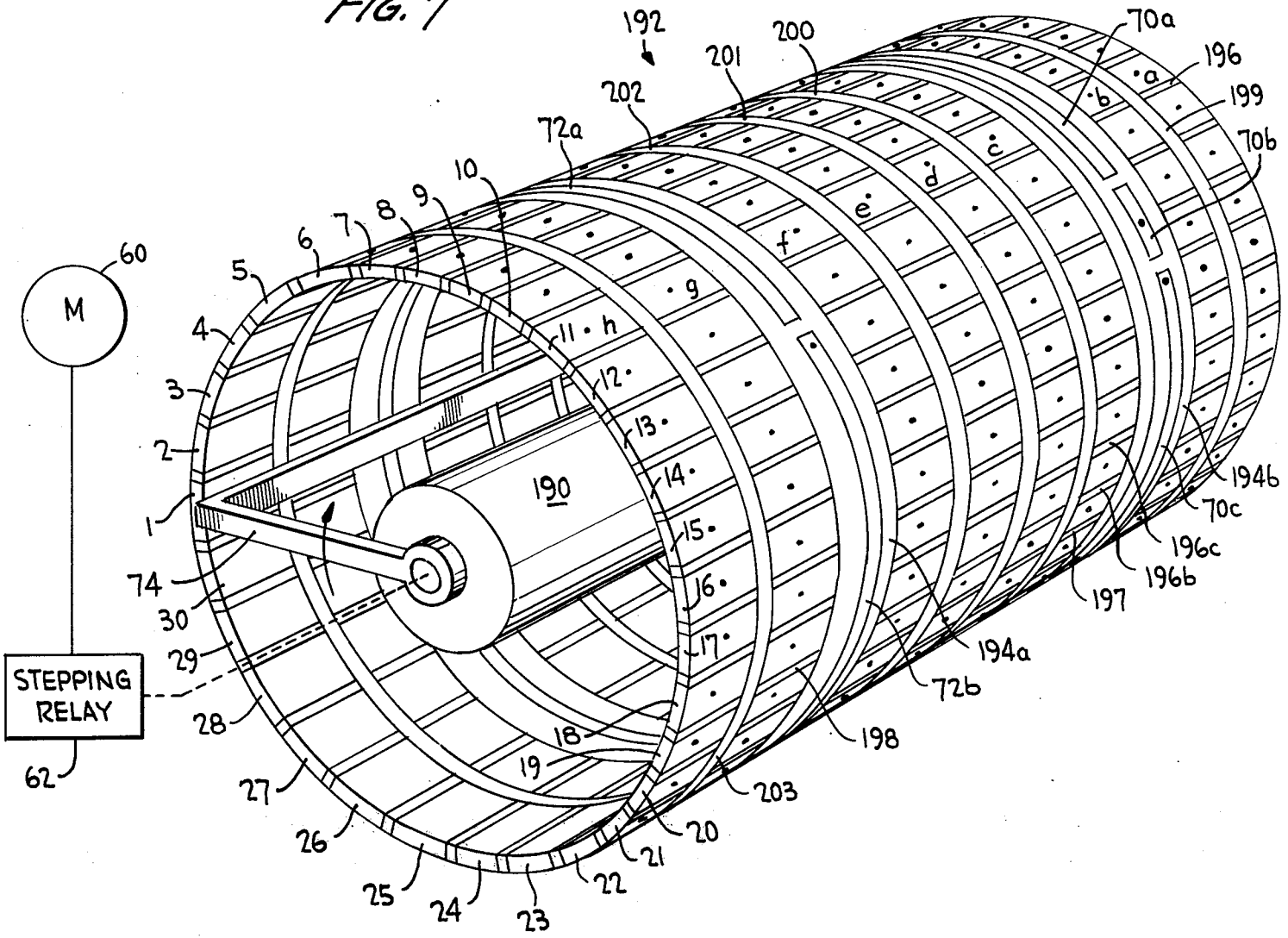
FIG. 7 is a perspective view of an embodiment of the essential components of a circular stepping switch used in the electrical control system of the present invention for selectively and sequentially actuating indicator lights of a display device.

In accordance with a preferred embodiment of the traffic display control system described herein, the pulse output train from stepping switch relay 62 provides pulses which are spaced approximately at two seconds intervals, the pulse train output from stepping switch relay 62 causes movable switch contact 74 to be sequentially stepped along switch contact positions 1–30 of stepping switch rotor 192 (FIG. 7). Each switch position 1–30 includes eight auxiliary switch contacts a, b, c, d, e, f, g and h and stepping switch 64 includes electrically constant contact plates **70*a*, 70*b*, 70*c*, 70*d* and 72*a*, 72*b*, 72*c* as illustrated in FIGS. 6A–6C. Electrical contact plate sections 70*a* and 72*a* include switching positions 1–13; electrical contact plate section 70*b* comprises switching positions 14–15; electrical contact plate section 70*c* comprises switching positions 16–28; electrical contact plate section 70*d* comprises switching positions 29–30; electrical contact plate section 72*b* includes switch positions 14–28; and electrical contact plate section 72*c* includes switch positions 29–30**.

The movement of movable switching contact 74 through switch positions 1–30 comprises one full STOP-GO cycle for the North-South and East-West lane signal devices, which are illustrated in block diagrammatic format in FIGS. 6A and 6C, respectively.

The following are the interconnections of the lighting elements of the North-South lane switching device illustrated in FIG. 6A. 110 volts A.C. from a power source (not shown) on lines 78 is provided to background lighting elements 80, 82 for the STOP-GO indicator 44' and street indicator 20', respectively. STOP indicator 42' is serially connected to red left vertical strip indicator 14' and both of the aforementioned lighting elements are connected to ground. GO indicator 44' is serially connected with green right vertical strip indicator 16', and both of the aforementioned lighting elements are connected to ground as illustrated in FIG. 6A. The green and red lighting elements in horizontal rows 21–36 are respectively connected to ground via lines 84 and 86.

STOP indicator 42' is connected to electrical switch contact sections **70*d* and 72*b*. GO indicator 44' is connected to electrical switch contact section 70*a*. The green lighting elements in horizontal rows 21'–36' are respectively connected to auxiliary switch contacts a, b, c, d in switch positions 1–13 of electrical switch contact section 70*a*. The green lighting elements of horizontal rows 21'–24' are connected to auxiliary switch contacts a, b, c and d in switch position 1 of electrical contact switch section 70*a*. In a similar manner, the auxiliary switch contacts a, b, c and d in switch position 2 of electrical switch contact section 70*a* are respectively connected to the green lighting elements in horizontal rows 22'–25'. The auxiliary contacts a, b, c and d of switch positions 3–13 of electrical switch contact section 70*a* are connected to the green lighting elements in the horizontal rows 23'–36'** in a corresponding manner as illustrated in FIG. 6A.

The red lighting elements in the horizontal rows 21'–24' are connected to auxiliary switch contacts a, b, c and d in switch position 14 of electrical contact switch section **70*b*. Additionally, the auxiliary switch contacts a, b, c and d of switch positions 14 and 15 are interconnected with auxiliary switch contacts e, f, g and h of switch positions 16–18 as illustrated in FIG. 6B. The red lighting elements in horizontal rows 22'–25' are respectively connected to auxiliary switch contacts e, f, g and h of switch position 19 in electrical switch contact section 70*c*. In a similar manner, auxiliary switch contacts e, f, g and h of switch positions 20'–28' are respectively connected to the red lighting elements in horizontal rows 23'–26'** as illustrated in FIGS. 6A and 6B.

The following is a description of the interconnection of the lighting elements of the East-West lane traffic device illustrated in block diagrammatic form in FIG. 6C. The 110 volt power input on line 78 is respectively applied to the lighting elements for the background lighting of STOP-GO indicator 12" and street indicator 20". The interconnection of STOP indicator 42", GO indicator 44", red left vertical strip indicator 14" and right green vertical strip indicator 16", and street indicator 20" with ground are exactly as described above with respect to the North-South lane traffic device.

STOP indicator 42" is interconnected to electrical switch contact sections **70*b* and 72*c* as illustrated in FIGS. 6A–6C. GO indicator 44" is connected to electrical switch contact section 70*c*. The green lighting elements in horizontal rows 21"–24" are connected to auxiliary switching contacts a, b, c and d of switch position 16 in electrical switching contact section 70*c*. The green lighting elements in horizontal rows 22"–25" are interconnected to auxiliary switch contacts a, b, c and d of switch position 17. In a similar manner, the green lighting elements in horizontal rows 26"–36" are interconnected to the auxiliary switch contacts a, b, c and d of switch positions 18–28** as shown in FIGS. 6B and 6C.

Auxiliary switching contacts e, f, g and h of switch positions 1, 2 and 3 in electrical contact switch section **72*a*, are respectively bridged as illustrated in FIG. 6A, and auxiliary switch contacts e, f, g and h in switch positions 29 and 30 of electrical switch contact section 72*c* are also respectively bridged as illustrated in FIG. 6C. The bridging of the aforementioned auxiliary switch contacts, as well as the bridging of auxiliary switch contacts a, b, c and d of switching positions 14 and 15** (previously described) provide a delay in the sequencing of the red lighting elements for the respective North-South and East-West lane traffic devices that will be described more fully hereinafter in connection with the signal light operational sequence shown in Table I.

Continuing with the connection of the lighting elements in the East-West lane traffic device of FIG. 6C, the red lighting elements in horizontal rows 21"–24" are interconnected to auxiliary switch contacts e, f, g and h of switch positions 29 and 30 and electrical switch contact section *72c* as illustrated in FIG. 6C. Additionally, the red lighting elements in horizontal rows 21"-24" are also interconnected to the auxiliary contacts e, f, g and h of switch positions 1-3 in electrical contact switch section *72a* as illustrated in FIGS. 6A-6C. The red lighting elements in horizontal rows 22"-25" are respectively interconnected to auxiliary contacts e, f, g and h in switch position 4 of electrical contact switch section *72a*. In a similar manner, the auxiliary contacts e, f, g and h of switch positions 5-15 are respectively interconnected with the red lighting elements in horizontal rows 23"-36".

The following is a brief description of the interconnection of the conductors between FIGS. 6A and 6B and FIGS. 6B and 6C.

Terminals **90*a*-106*c* of FIG. 6A are respectively connected to terminals 90*b*-106*b* of FIG. 6B; terminals 107*a*-151*a* of FIG. 6A are respectively connected to terminals 107*b*-151*b* of FIG. 6B; terminals 107*b*-159*b* of FIG. 6B are respectively connected to terminals 107*c*-159*c* of FIG. 6C; and terminals 161*b*-178*b* of FIG. 6B are respectively connected to terminals 161*c*-177*c* of FIG. 6C**.

In accordance with the aforedescribed interconnection between the auxiliary switching contacts a-h, associated with electrical contact switch sections **70*a*-70*d* and 72*a*-72*c*, and the following lighting elements: the red and green lighting elements in horizontal rows 21'-36' and 21"-36"; the interconnections with the STOP-GO indicators 12', 12"; the respective interconnections with the red vertical strip indicators 14', 14", and green vertical strip indicators 16', 16" (all as described above and shown in FIGS. 6A-6C), the signal light operational sequence shown in Table I is obtained as follows by movement of stepping switch blade 74 from switching positions 1-30** in a sequential stepwise manner.

With movable switch contact 74 at switching position 1, the following lighting elements of the North-South lane traffic device are energized: the green lighting elements in horizontal light rows 21'-24', green vertical strip indicator 16' and GO indicator 44', the latter two elements remaining energized while movable switching contact 74 moves through switching positions 1-13, thereby constantly applying 24 volts to electrical contact switch section *70a*. With respect to the East-West lane traffic device, the following lighting elements are lit: the red lighting elements in horizontal light rows 21"-24", red left vertical strip indicator 14" and STOP indicator 42", the latter two elements remaining energized while movable switching contact 74 moves through switching positions 1-15 as 24 volts is constantly applied to electrical contact switch section *72a*. Thus, the North-South lane traffic device is in the condition represented by FIG. 1 with GO indicator 44', vertical strip indicator 16' and the green elements in a block of four horizontal rows 21'-24' of light display grid 18 all indicating the color green. The East-West lane traffic device is in the condition illustrated in FIG. 4 with the STOP indicator 42', vertical strip 42", vertical strip indicator 14" and the red lighting elements in a block of four horizontal rows 21"-24" indicating red.

When movable switching contact 74 moves from switch position 1 to switch position 2, the green lighting elements in horizontal row 21 of the North-South lane traffic device and the red lighting elements in horizontal light row 21" of the East-West lane traffic device are extinguished simultaneously, the green lighting elements in horizontal light row 25' of the North-South lane traffic device and the red lighting elements in horizontal light row 25" of the East-West lane traffic light are simultaneously lit.

As movable switching contact 74 moves through stepping switch positions 3-13, the green lights in horizontal light rows 26'-36' of the North-South lane traffic device are respectively sequentially operated as shown in Table I. As indicated therein, a block of four horizontal light rows of green lights descends one horizontal row at respective time intervals of two seconds with the green lights in the uppermost horizontal row being extinguished as the green lights in a next adjacent bottom horizontal light row are energized. However, with respect to the East-West lane traffic device, the red lighting elements in horizontal light rows 21"-24" remain energized through stepping switch positions 1-3. This provides a four second delay for traffic to move through the intersection. When movable switching contact 74 moves from stepping switch position 3 to stepping switch position 4, the red lighting elements in horizontal light row 21" are extinguished and the red lighting elements in horizontal light row 25" are energized such that a block of four horizontal light rows of red lighting elements are energized in horizontal light rows 22"-25". As moving switch contact 74 moves through stepping switch positions 4-15, the red lights in horizontal light rows 26"-36" of the East-West lane traffic device are sequenced as shown in Table I. As indicated therein, a block of four horizontal light rows of red lights descends one horizontal row at a time with the red lights in the uppermost horizontal row being extinguished as the red lights in a next adjacent bottom horizontal light row are energized.

As the movable switching contact 74 moves from switch position 13 to switch position 14, the lighting elements of the North-South lane traffic device are operated as follows: the green lighting elements in horizontal light rows 33'-36', the green light vertical strip indicator 16' and GO indicator 44' are extinguished and the red lighting elements in horizontal light rows 21'-24', the red left vertical strip indicator 14' and STOP indicator 44' are all lit and the latter two lighting elements remain lit throughout the movement of movable switching contact 74 from switching position 14 to 30. The red lights in the block of four horizontal light rows 21'-24' remain lit through movement of switching contact 74 through switch positions 14-18.

When movable switching contact 74 moves from switch positions 13 through 15, the lighting elements of the East-West lane traffic device are operated as follows: the red lighting elements in horizontal light rows 35" and 36" are successively energized while simultaneously therewith red lighting elements in light rows 31" and 32" are extinguished. Thereby, with movable switching contact 74 at switch position 15 the red lights in horizontal light row 33"-36" are lit. Red left vertical strip indicator 14" and STOP indicator 42" remain energized during the aforementioned movement of switching contact 74 from switch positions 13-15. The aforementioned operation of the lighting elements in the North-South lane and the East-West lane enables traffic to move through or clear the intersection prior to the East-West lane traffic receiving a GO condition.

Continuing with the operation of the East-West lane traffic device lighting elements, with movement of movable switch contact 74 from switch position 15 to switch position 16, the red lighting elements in horizontal light rows 33"-36" are extinguished and simultaneously therewith the green lighting elements in horizontal light rows 21"-24", green vertical strip indicator 16" and GO indicator 44" are all lit simultaneously. With movement of the movable switching contact 74 from switching position 16 to switching position 17, the sequencing of the downward movement of the green lights in a block of four horizontal light rows is initiated whereby the green lighting elements in horizontal light row 21" are extinguished and simultaneously therewith the green lighting elements in horizontal light row 25" are lit. With movement of switching contact 74 from switch positions 18 through 28, the red lighting element in the horizontal light row 21"-36" of the North-South lane traffic device and the green lighting element in horizontal light rows 21"-36" of the East-West lane traffic device are sequentially operated such that the respective display of a block of four rows of red and green lights in the North-South lane and East-West lane traffic devices, respectively, move downwardly one horizontal light row at a time. Thus, when switching contact 74 reaches switch position 28 the red lighting elements in horizontal light rows 31'-34' of the North-South lane are energized and the green lighting elements in horizontal light rows 33"-36" of the East-West lane traffic device are lit. Red left vertical strip indicator 14' and STOP indicator 42' of North-South lane traffic device are lit as they have remained energized with movement of movable switching contact 74 from switch position 16 through switch position 28. Also, the green lighting vertical strip 16" and GO indicator 44" of the East-West lane traffic device are lit with moving switch contact 74 at switch position 28, as those elements have also been constantly energized with movement of movable switching contact 74 from switching position 16 through switching position 28.

With movement of movable switching contact 74 from switch position 28 to 29, the red lighting elements in horizontal light row 31' and the red lighting elements in horizontal light row 35' of the North-South lane traffic device are respectively extinguished and lit such that with the movable switching contact at switch position 29, the red lighting elements in horizontal light rows 33'-36' are lit. Simultaneously therewith, the lighting elements in the East-West lane traffic device are operated as follows: the green lighting elements in horizontal light rows 33"-36", the green right vertical indicator strip 16", and GO indicator 44" are extinguished, the red lighting elements in horizontal light rows 21"-24", red left vertical strip indicator 14" and STOP indicator 42" are energized. Simultaneously therewith red left vertical strip indicator 14' and STOP indicator 42' are also lit. Vertical strip indicators 14', 14" and STOP indicators 42', 42" of the North-South and East-West lane traffic devices, respectively, remain energized during movement of switching contact 74 from switch position 29 to switch position 30, thereby providing a four second delay for traffic to move through the intersection in the East-West lane traffic direction before the traffic in the North-South direction is given a GO condition. Also, with movement of switch contacts 74 from switch position 29 to switch position 30, the red lighting elements in horizontal light row 32' and 36' of the North-South lane traffic device are respectively extinguished and energized, such that the block of red lighting elements in the four horizontal rows 33'-36' are energized.

With movement of movable switching contact 74 from switch position 30 to switch position 1, the lighting elements of the North-South lane traffic device are operated as follows: the red lighting elements in horizontal light row 33'-36' are extinguished and simultaneously therewith the green lighting elements in horizontal light rows 21'-24', are lit, red left vertical indicator strip 14' and STOP indicator 42' are extinguished, and green right vertical indicator strip 16' and GO indicator 44' are energized.

The lighting elements of the North-South lane and East-West lane traffic devices are cyclically operated as described above with cyclic movement of movable switching contact 74 through switch positions 1-30.

A perspective view of the essential components of a stepping switch for sequentially operating the North-South lane and East-West lane traffic light display devices (shown in FIGS. 6A and 6C, respectively) is illustrated in FIG. 7. Moving switch contact 74 is rotatably mounted to shaft 190 so as to be stepped one position at a time in response to output pulses from stepping switch relay 62 as has previously been described with respect to FIG. 6A. The thirty switching positions are designated 1-30 around the lower left rim of switching stator 192. The electrically constant switching sections (only switching sections **70*a*, 70*b* and 72*a*, 72*b* being shown in FIG. 7) are respectively mounted on electrically insulated strips 194*a*, 194*b*. Adjacent rows of auxiliary switching contacts a through h are separated by insulating strips. For example, adjacent rows of auxiliary contacts a, b are separated by electrically insulating strips 196, adjacent rows of auxiliary contacts c-f are respectively separated by electrically insulating strips 197, and adjacent rows of auxiliary contacts g, h are separated by electrically insulating strips 198. Additionally, auxiliary switching contacts a, b are separated by peripherally running insulating strip 199, auxiliary switching contacts c,d, d,e, and e,f are respectively separated by peripherally running insulating strips 200, 201 and 202; and auxiliary switching contacts g, h are separated by peripherally running insulating strip 203. The switching sections and auxiliary switching contacts are mounted on stator 192 such that their respective inner conductive surfaces lie in the same plane as the inner surface of stator 192, such that moving switch contact 74 makes electrical contact with all of the auxiliary switching contacts a-h and the respective switching contact sections therebetween at each and every switching position 1-30. Terminals are provided on each of auxiliary switching contacts a-h for connection of an electrical conductor thereto as illustrated in FIGS. 6A-6C**.

The 24 volts A.C. excitation is applied to movable switch contact 74 by a commutator device (not shown) in a manner that is well known to those skilled in the art. Additionally, the stepped rotation of movable switch contact 74, in accordance with the pulses from stepping switch relay 62, is applied to an electromagnetic assembly (not shown) within shaft 190 in a manner also well known to those skilled in the stepping switch art. The manner of exciting and actuating moving switch blade 74 forms no part of the present invention.

As shown in FIG. 7, movable switching contact 74 is positioned at switch position 1 and is rotated clockwise in the direction of the arrow by the application of the aforementioned switching pulses such that the 24 volts A.C. is successively applied at two second intervals to the auxiliary switching contacts a–h and the respective electrical switching sections associated therewith at each and every switching position 1–30 in a repetitive cyclic manner. In an actual operative embodiment, stator 192 would be mounted in a suitable insulated housing, the enclosure of shaft 190 and stator 192 forming no part of the present invention and no description thereof being provided herein as such structure is well known to those skilled in the art and is not necessary for carrying out the present invention.

Figure 8:
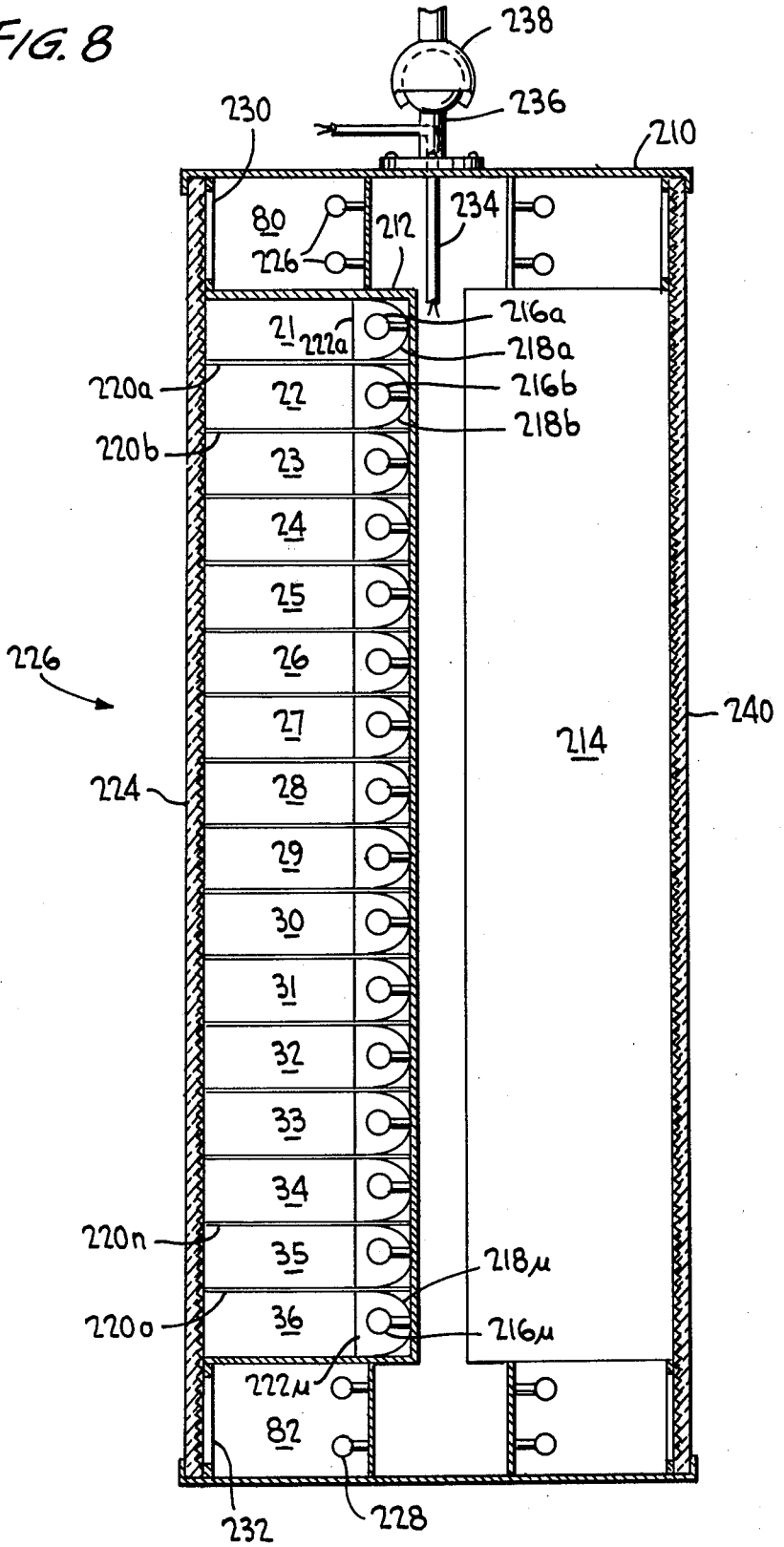
FIG. 8 illustrates in cross section an exemplary embodiment of the housing of a traffic display device in accordance with the invention.

FIG. 8 shows a cross section of an embodiment of a housing for enclosing the lighting elements of a traffic signal device in accordance with the present invention, for example, either the North-South lane or East-West lane traffic devices diagrammatically and schematically shown in FIGS. 6A and 6C. Mounted within housing 210 are two identical sub-housings 212, 214, each enclosing the lighting elements **216*a*–216*u* respectively included within one column of horizontal light rows 21–36. Only the lighting elements enclosed in sub-enclosure 212 are illustrated in FIG. 8 as the lighting elements in sub-enclosure 214 are identically mounted. Light bulbs 216*a*–216*u* are high-intensity light bulbs known to the traffic signal industry and, as described previously, either the bulbs or reflecting lenses 218*a*–218*u* are colored red and green. As described previously, the red and green colors are staggered in alternate horizontal lighting rows 21–36 such that lighting elements 216*a*, 216*c*, 216*e*, etc., for example, emit red light, whereas lighting elements 216*b*, 216*d*, 216*f*, etc. emit green light. Each of lighting elements 216*a*–216*u* is separated by a solid metal light shield 220*a*–220*o*. Lighting elements 216*a*–216*u* each include lenses 220*a*–220*u* mounted as shown in FIG. 8. Transparent plastic prismatic frontal shield 224 is mounted over face 226 of housing 210 to evenly spread the light emanating from each of lighting elements 216*a*–216*u*, as well as the background light provided by bulbs 226, 228, respectively, for STOP-GO indicator background 80 and street light background 82. As previously described, light bulbs 226 and 228 are constantly lit to provide a constant background for the STOP-GO indicator 12 and street light indicator 20, the respective elements of which are respectively mounted on panels 230, 232 as shown in FIG. 8**.

The electrical conductors for the 115 volt and 24 volt excitation to bulbs 226, 228 and lighting elements **216*a*–216*u* are provided via cable 234 which extends through hollow ball mounting 236 which is engageable with socket 238 to provide a means for swingably suspending enclosure 210 above a street intersection. Identical background lighting elements for STOP-GO indicator 12, street light indicator 20 and the green and red lighting elements are provided in the other half of enclosure 210 in an identical manner as that described above. The red and green vertical strip indicators 14, 16 are not shown in FIG. 8 but may be centrally mounted along the respective edges of a plane extending through the center of traffic light enclosure 210. Alternatively, separate vertical strip indicators 14, 16 can be provided at each outer edge of each sub-enclosure 212, 214. Therefore, it is readily apparent that traffic signal indications in accordance with the previous description will emanate from faces 226 and 240 of traffic light enclosure 210**, thereby providing traffic signal indications for both directions of either a North-South lane or an East-West lane traffic signal device.

The electrical control circuitry described with respect to FIGS. 6A–6C may be mounted in a separate housing at an intersection with the necessary electrical cabling running therefrom to each of two or more traffic signal display enclosures 210, to provide traffic signal indications for North-South lane and East-West lane traffic devices. It will also be readily apparent to those skilled in the art that the number of horizontal light rows 21–36, and lighting elements within each horizontal light row, may be varied to meet the demands of the traffic at particular intersections. For example, at intersections controlling relatively high speed traffic, the number of horizontal light rows and lighting elements in each light row may be increased to increase and intensify the signal indication from a given traffic display device. Additionally, the number of vertical strip indicators may be increased to intensify the light output therefrom. Moreover, the number of switching positions may be varied in accordance with the number of horizontal light rows. Also, intervals between the stepping switch position may be varied to provide greater or lesser delays in the signal light operational sequence to meet the demands of individual traffic control situations at particular intersections.

Table I

SIGNAL LIGHT OPERATIONAL SEQUENCE

| Stepping Switch Position No's. | North-South Lane | East-West Lane | Light Rows No's On | Red Left Vertical | Green Right Vertical | Stop | Go. |
|---|---|---|---|---|---|---|---|
| No. 1 | Green | | 1-2-3-4 | | On | | On |
| | | Red | 1-2-3-4 | On | | On | |
| No. 2 | Green | | 2-3-4-5 | | On | | On |
| | | Red | 1-2-3-4 | On | | On | |
| No. 3 | Green | | 3-4-5-6 | | On | | On |
| | | Red | 1-2-3-4 | On | | On | |
| No. 4 | Green | | 4-5-6-7 | | On | | On |
| | | Red | 2-3-4-5 | On | | On | |
| No. 5 | Green | | 5-6-7-8 | | On | | On |
| | | Red | 3-4-5-6 | On | | On | |
| No. 6 | Green | | 6-7-8-9 | | On | | On |
| | | Red | 4-5-6-7 | On | | On | |
| No. 7 | Green | 7-8-9-10 | | On | | On | |
| | | Red | 5-6-7-8 | On | | On | |
| No. 8 | Green | | 8-9-10-11 | | On | | On |
| | | Red | 6-7-8-9 | On | | On | |
| No. 9 | Green | | 9-10-11-12 | | On | | On |
| | | Red | 7-8-9-10 | On | | On | |
| No. 10 | Green | | 10-11-12-13 | | On | | On |
| | | Red | 8-9-10-11 | On | | On | |
| No. 11 | Green | | 11-12-13-14 | | On | | On |
| | | Red | 9-10-11-12 | On | | On | |
| No. 12 | Green | | 12-13-14-15 | | On | | On |
| | | Red | 10-11-12-13 | On | | On | |
| No. 13 | Green | | 13-14-15-16 | | On | | On |
| | | Red | 11-12-13-14 | On | | On | |
| No. 14 | Red | | 1-2-3-4 | On | | On | |
| | | Red | 12-13-14-15 | On | | On | |
| No. 15 | Red | | 1-2-3-4 | On | | On | |
| | | Red | 13-14-15-16 | On | | On | |
| No. 16 | Red | | 1-2-3-4 | On | | On | |
| | | Green | 1-2-3-4 | | On | | On |
| No. 17 | Red | | 1-2-3-4 | On | | On | |
| | | Green | 2-3-4-5 | | On | | On |
| No. 18 | Red | | 1-2-3-4 | On | | On | |
| | | Green | 3-4-5-6 | | On | | On |
| No. 19 | Red | | 2-3-4-5 | On | | On | |
| | | Green | 4-5-6-7 | | On | | On |
| No. 20 | Red | | 3-4-5-6 | On | | On | |
| | | Green | 5-6-7-8 | | On | | On |
| No. 21 | Red | | 4-5-6-7 | On | | On | |
| | | Green | 6-7-8-9 | | On | | On |
| No. 22 | Red | | 5-6-7-8 | On | | On | |
| | | Green | 7-8-9-10 | | On | | On |
| No. 23 | Red | | 6-7-8-9- | On | | On | |

Table I-continued

SIGNAL LIGHT OPERATIONAL SEQUENCE

| Stepping Switch Position No's. | North-South Lane | East-West Lane | Light Rows No's On | Red Left Vertical | Green Right Vertical | Stop | Go. |
|---|---|---|---|---|---|---|---|
| | | Green | 8-9-10-11 | | On | | On |
| No. 24 | Red | | 7-8-9-10 | On | | On | |
| | | Green | 9-10-11-12 | | On | | On |
| No. 25 | Red | | 8-9-10-11 | On | | On | |
| | | Green | 10-11-12-13 | | On | | On |
| No. 26 | Red | | 9-10-11-12 | On | | On | |
| | | Green | 11-12-13-14 | | On | | On |
| No. 27 | Red | | 10-11-12-13 | On | | On | |
| | | Green | 12-13-14-15 | | On | | On |
| No. 28 | Red | | 11-12-13-14 | On | | On | |
| | | Green | 13-14-15-16 | | On | | On |
| No. 29 | Red | | 12-13-14-15 | On | | On | |
| | | Red | 1-2-3-4 | On | | On | |
| No. 30 | Red | | 13-14-15-16 | On | | On | |
| | | Red | 1-2-3-4 | On | | On | |
| No. 31 | Green | | 1-2-3-4 | | On | | On |
| | | Red | 1-2-3-4 | On | | On | |

What is claimed is:

1. A traffic signal device, comprising:

a traffic display field for indicating traffic conditions and including first and second vertically extending strip lights respectively emitting red and green light, a grid comprising a plurality of horizontally extending light rows, each light row including a plurality of alternately positioned green and red lighting elements, said grid being positioned between said first and second strip lights, and a STOP-GO indicator for alternately indicating a STOP or a GO condition in respective red and green lights;

means for cyclically controlling the lighting of the lighting elements in said traffic display field to indicate respective alternate STOP and GO traffic conditions, said GO condition being indicated by the lighting of said second vertical strip, the GO indicator portion of said STOP-GO indicator and the green lighting elements in a block of adjacent horizontal light rows, whereby the block of energized green lighting elements descends from the top to the bottom of said grid in successive steps having a predetermined delay interval between said steps; and said STOP condition being indicated by the lighting of said first vertical strip, the STOP indicator portion of said STOP-GO indicator and the red lighting elements in a block of adjacent horizontal light rows, whereby the block of energized red lighting elements descends from the top to the bottom of said grid in successive steps, with a predetermined delay interval between said steps.

2. A traffic signal device as in claim 1 wherein said means for cyclically controlling the lighting of the lighting elements in said traffic display field comprises a stepping switch including a stator with a plurality of stepping switch positions around the periphery thereof, said stepping switch including a switching contact rotatable in a stepwise manner between successively adjacent stepping switch positions and being connected to an A.C. voltage source, first and second electrical contacts extending in spaced relation around the periphery of said stator, first and second groups of switching contacts respectively associated with said first and second electrical contact elements, said first electrical contact being connected to said GO indicator, said second electrical contact being connected to said STOP indicator, said first group of switching contacts being respectively connected to the green lighting elements and said second group of switching contacts being respectively connected to said red lighting elements, said switching contact contacting either said first electrical contact and said first group of switching contacts or said second electrical contact and said second group of switching contacts in each of said switching positions; and means for energizing said stepping switch to rotate said switching contact in a stepwise manner between said plurality of stepping switch positions, with a predetermined delay between each step movement of said switching contact.

3. A traffic signal device as in claim 2 wherein said plurality of first and second groups of switching contacts are respectively connected to said green and red lighting elements whereby the respective blocks of said red and green lighting elements are extinguished simultaneously during a change from a STOP condition to a GO condition and vice versa.

4. A traffic signal device as in claim 2 wherein portions of said second group of switching contacts are connected to said red lighting elements in a block of horizontal light rows at the bottom of said grid to provide a delay in the operation of said red elements during a changeover from a STOP to a GO condition.

5. A traffic signal device as in claim 1 wherein said plurality of alternately positioned green and red lighting elements are staggered with respect to one another in adjacent horizontal light rows.

6. A traffic signal device as in claim 5 wherein said traffic display field further includes a street indicator, said street indicator and said STOP-GO indicator being positioned at respective opposite upper and lower ends of said grid.

7. A traffic signal device as in claim 6 further comprising means for providing a constant background light to said STOP-GO indicator and said street indicator.

8. A traffic signal device as in claim 7 wherein there are sixteen of said horizontally extending light rows, and said block of energized green lighting elements and said block of energized red lighting elements each comprise a block of four adjacent horizontal light rows.

9. A traffic signal system for controlling traffic at an intersection of first and second streets, comprising:

first and second traffic signal devices each including two traffic display fields, each said traffic display field including first and second vertically extending strip lights respectively emitting red and green light, a grid comprising a plurality of horizontally extending light rows, each light row including a plurality of alternately positioned green and red lighting elements, said grid being positioned between said first and second strip lights, and a STOP-GO indicator for alternately indicating a STOP or a GO condition in respective red and green lights;

means for cyclically controlling the lighting of the lighting elements in said traffic display field to indicate respective alternate STOP and GO traffic conditions, said GO condition being indicated by the lighting of said second vertical strip, the GO indicator portion of said STOP-GO indicator and the green lighting elements in a block of adjacent horizontal light rows, whereby the block of energized green lighting elements descends from the top to the bottom of said grid in successive steps having a predetermined delay interval between said steps;

said STOP condition being indicated by the lighting of said first vertical strip, the STOP indicator portion of said STOP-GO indicator and the red lighting elements in a block of adjacent horizontal light rows, whereby the block of energized red lighting elements descends from the top to the bottom of said grid in successive steps, with a predetermined delay interval between said steps;

the respective traffic display fields of each of said first and second traffic signal devices being connected in parallel and each facing in opposite directions along the respective first and second streets; and means for cyclically controlling the lighting of the lighting elements in said first and second traffic signal devices for indicating respective alternate STOP and GO traffic conditions.

10. A traffic signal system as in claim 9 wherein said means for cyclically controlling comprises a stepping switch including a stator having a plurality of stepping switch positions around the periphery thereof, first and second electrical contact members extending in spaced relation around the periphery of said stator, first and second groups of switch contacts respectively associated with said first and second electrical contact members;

said stepping switch including a switching contact rotatable in a stepwise manner between successively adjacent stepping switch positions and being connected to an A.C. voltage source;

said first electrical contact member including first and second electrical contact sections, the switching contacts of said first and second switching sections being respectively connected to the green lighting elements in respective horizontal light rows of said first and second traffic signal devices, respectively;

said second electrical contact member including third and fourth contact switching sections, the switching contacts of said third and fourth switching sections being respectively connected to the red lighting elements in respective horizontal rows of said first and second traffic signal devices, respectively;

the GO indicator of said first and second traffic signal devices being respectively connected to said first and second switch contact sections;

the STOP indicator of said first and second traffic signal devices being respectively connected to said third and fourth switching sections; and means for energizing said stepping switch to rotate said switching contact in a stepwise manner between said plurality of stepping switch positions, with a predetermined delay between each step movement of said switching contact.

11. The traffic signal system as in claim 10 wherein said first electrical contact member further includes a fifth switching contact section positioned between said first and second switch contact sections and a sixth switch contact section positioned between said second and said first switch contact section;

said second electrical contact member further includes a seventh switch contact section positioned between said fourth and third contact switch sections;

said fifth switching contact section being connected to the STOP indicator of said second traffic display device and to said third and seventh switch contact sections;

said sixth switch contact section being connected to said fourth switch contact section and to the STOP indicator of said first traffic signal device, the switching contacts associated with said fifth and seventh switch contact sections being respectively connected to the red lighting elements in a block of horizontal rows in said first and second traffic signal devices respectively.

12. The traffic signal system as in claim 11 wherein the switching contacts associated with said third switch contact section and connected to the red lighting elements in a block of horizontal light rows at the top of the grids in said second traffic display device are bridged; and the switching contacts associated with said fifth switch contact section and the switching contacts associated with said fourth switch contact section are bridged and connected to the red lighting elements in a block of horizontal rows at the top of the grids in said first traffic signal device, whereby a delay in the sequencing of the red lighting elements in the horizontal light rows of said first and second traffic signal devices are delayed with movement of said switching contact through several switching positions subsequent to a change from a GO condition to a STOP condition in each of said first and second traffic signal devices.

* * * * *